US008191995B2

(12) United States Patent
Lee et al.

(10) Patent No.: US 8,191,995 B2
(45) Date of Patent: Jun. 5, 2012

(54) PRINTHEAD FOR THERMAL INKJET PRINTING AND THE PRINTING METHOD THEREOF

(75) Inventors: Francis Chee-Shuen Lee, Kowloon (HK); Wei-Fu Lai, Kowloon (HK)

(73) Assignee: Hong Kong Applied Science and Technology Research Institute Co. Ltd., Shatin, New Territories (HK)

( * ) Notice: Subject to any disclaimer, the term of this patent is extended or adjusted under 35 U.S.C. 154(b) by 310 days.

(21) Appl. No.: 12/651,144

(22) Filed: Dec. 31, 2009

(65) Prior Publication Data

US 2011/0157281 A1 Jun. 30, 2011

(51) Int. Cl.
*B41J 2/05* (2006.01)

(52) U.S. Cl. ..... 347/57

(58) Field of Classification Search ..... 347/40, 347/54, 56–58

See application file for complete search history.

(56) References Cited

U.S. PATENT DOCUMENTS

| | | | |
|---|---|---|---|
| 5,635,968 | A | 6/1997 | Bhaskar et al. |
| 5,953,029 | A | 9/1999 | Keefe et al. |
| 6,860,585 | B2 | 3/2005 | Serra et al. |
| 6,921,148 | B2 * | 7/2005 | Nakamura et al. ..... 347/40 |

* cited by examiner

*Primary Examiner* — An Do

(74) *Attorney, Agent, or Firm* — Merchant & Gould P.C.

(57) ABSTRACT

The present invention relates to a printhead for thermal inkjet printing and the printing method thereof. The printhead includes: a substrate having a plurality of orifices with a firing element in each of said plurality of orifices, wherein said plurality of orifices are arranged in a single column, and said printhead is disposed at an angle to a horizontal direction along which said printhead scans; and firing circuits for energizing said plurality of firing elements to eject ink on a printing medium by respectively transmitting a plurality of firing signals to said plurality of firing elements. According to the present invention, the print speed and resolution can be improved.

15 Claims, 5 Drawing Sheets

Relative motion between head and paper

PRINTHEAD FOR THERMAL INKJET PRINTING AND THE PRINTING METHOD THEREOF

FIELD OF THE INVENTION

The present invention relates to a printhead. More particularly, the present invention relates to a printhead for thermal inkjet printing.

DESCRIPTION OF THE PRIOR ART

Inkjet printing mechanisms are used in a variety of different products. The function of the printhead is to eject minute ink drops, disposed from the orifices, onto a sheet of printing medium. To print an image, the printhead is mounted to a carriage in the printer. The carriage traverses over the surface of a blank sheet of printing medium, and the printhead is controlled to eject drops of ink at appropriate times pursuant to commands from a microcomputer or other controller. In this manner, the pattern of the desired images or texts are formed by ejecting ink drops onto print medium.

There are several ink drop ejection mechanisms that are known such as thermal inkjet technology, piezoelectrical inkjet technology and so forth. Here we implemented the thermal inkjet technology in the patent application. In a general thermal inkjet system, a barrier layer containing ink channels and vaporization chambers are formed in between a nozzle orifice plate layer and a substrate layer. This substrate layer typically contains arrays of heater elements, such as resistors, which are electrically connected to firing circuits respectively where will describe it later and resistors are selectively energized to heat ink within the vaporization chambers. Upon heating, an ink droplet is ejected from a nozzle associated with the energized resistor.

In recent years, research has been conducted in order to increase the degree of print resolution, print speed, and quality of thermal inkjet printing systems. Print resolution depends on the spacing of the adjacent ink-ejecting orifices and the adjacent heating resistors formed on the printhead substrate which means more ejection orifices disposed on the printhead substrate in the same area having higher resolution. Modern circuit fabrication techniques allow the placement of substantial numbers of resistors on a single printhead substrate. Specifically, an increasingly large number of resistors require a correspondingly large number of interconnection pads, leads, and the like. This increase in components and interconnect causes greater manufacturing/production costs, and increases the probability that defects will occur during the manufacturing process. U.S. Pat. No. 5,635,968 provides a special arrangement and driving method for the nozzle to solve the above problem.

U.S. Pat. No. 5,638,101 provides up to 600 dots per inch printing resolution in a single pass of during printing and the firing elements is arranged in 2 arrays. FIG. 1A shows the nozzles arrangement where to formed 600 dots per inch resolution with 2 arrays and stagger arrange. The two stagger columns of nozzles are energized to print a single vertical line with 600 DPI resolution as depicted in FIG. 1B. If the nozzle of one column has the resolution of 300 dpi, the stagger arrangement in FIG. 1A obtains the double resolution, i.e., 600 dpi.

To increase the print speed, U.S. Pat. No. 6,860,585 provides a different arrangement of the nozzle, but with lower resolution. As depicted in FIG. 2A, U.S. Pat. No. 6,860,585 slants the printhead by installing it onto a carriage with two columns of nozzles. The nozzles arranged on the same horizontal line are energized at the same time. FIG. 2B shows the ink ejected by the 2 stagger columns of nozzles in a printhead in FIG. 2A. Therefore, with appropriate timing for energizing the nozzles, such arrangement can print two vertical lines at the same time, so as to increase the print speed. However, the resolution is sacrificed.

Therefore, there is a need to improve the print resolution and print speed at the same time.

SUMMARY OF THE INVENTION

According to the present invention, the print speed and the resolution can be improved at the same time. According to an embodiment of the present invention, the crosstalk of the firing signals of nozzles is eliminated.

An embodiment of the present invention provides a substrate having a plurality of orifices with a firing element in each of said plurality of orifices, wherein said plurality of orifices are arranged in a single column, said plurality of firing elements are classified into a first number of groups, and each group comprises: a second number of firing elements, wherein said second number of firing elements in a group are arranged such that each of said second number of firing elements is energized at a different time, and the time difference for energizing any two adjacent firing elements is at least two predetermined time intervals, and are located such that two sequentially fired firing elements are separated by at least two other firing elements, and a firing circuit for energizing said plurality of firing elements to eject ink on a printing medium by respectively transmitting a plurality of firing signals to said plurality of firing elements; wherein said printhead is disposed at an angle to a horizontal direction along which said printhead scans, and said angle is substantially not equal to 90 degrees Another embodiment of the present invention provides a printhead for thermal inkjet printing, comprising: a substrate having a plurality of orifices with a firing element in each of said plurality of orifices, wherein said plurality of orifices are arranged in at least two columns, wherein said plurality of firing elements are classified into a first number of groups, and each group comprises a second number of firing elements, wherein said second number of firing elements in a group are arranged such that each of said second number of firing elements is energized at a different time, and the time difference for energizing any two adjacent firing elements is at least two predetermined time intervals, and are located such that two sequentially fired firing elements are separated by at least two other firing elements, and a firing circuit for energizing said plurality of firing elements to eject ink on a printing medium by respectively transmitting a plurality of firing signals to said plurality of firing elements; wherein firing elements energized in one column are independent of firing elements energized in another column, and said printhead is disposed at an angle to a horizontal direction along which said printhead scans; and said angle is substantially not equal to 90 degrees.

Another embodiment of the present invention provides a printing method for a printhead having a plurality of firing elements classified into a plurality of groups, comprising: energizing each of said plurality of firing elements by a plurality of firing signals, respectively, wherein each of said firing elements is energized at a different time, and the time difference for energizing any two adjacent firing elements is at least two predetermined time intervals; and wherein said plurality of firing elements are located such that two sequentially fired firing elements are separated by at least two other firing elements.

In order to make the aforementioned and other objects, features, and is advantages of the present invention more comprehensible, preferred embodiments accompanied with figures are described in detail below.

DETAILED DESCRIPTION

A preferred embodiment of the present application provides a printhead for thermal inkjet printing, comprising: a substrate having a plurality of orifices with a firing element in each of said plurality of orifices, wherein said plurality of orifices are arranged in a single column, and said printhead is disposed at an angle to a horizontal direction along which said printhead scans; and firing circuits for energizing said plurality of firing elements to eject ink on a printing medium by respectively transmitting a plurality of firing signals to said plurality of firing elements.

Figure 1A:
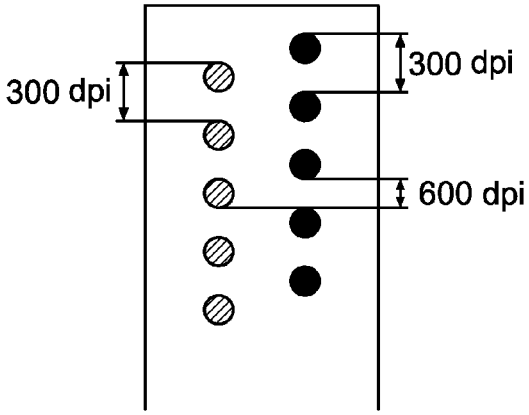
FIG. 1A illustrates the conventional nozzles arranged in 2 stagger columns.
Figure 1B:
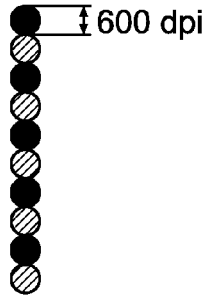
FIG. 1B illustrates dots printed by the nozzles in FIG. 1A.
Figure 2A:
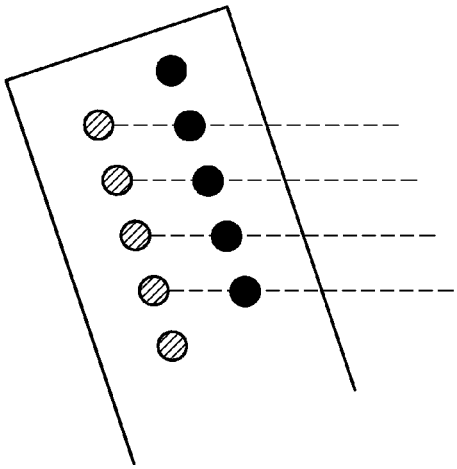
FIG. 2A illustrates another conventional nozzle arrangement with better printing rate.
Figure 2B:
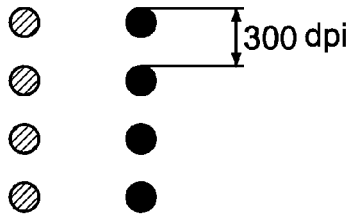
FIG. 2B illustrates dots printed by the nozzles in FIG. 2A.
Figure 3:
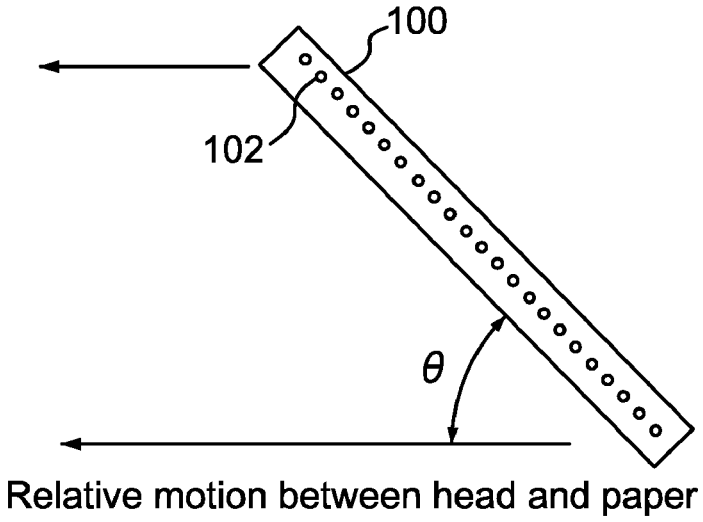
FIG. 3 illustrates the orientation of the printhead of a preferred embodiment of the present invention.

Please refer to FIG. 3, which shows the orientation of the printhead 100 according to an embodiment of the present invention. The arrows in FIG. 3 represent the motion of the printhead with respect to the printing medium, such as a blank paper. The printhead 100 includes a substrate having a plurality of orifices 102 thereon. Each orifice corresponds to a firing element for injecting ink. According to the preferable embodiment shown in FIG. 3, the orifices (or the nozzles) are arranged in a single column, and the printhead is disposed at an angle θ to a horizontal direction along which said printhead scans. The printhead further includes firing circuits for energizing the firing elements to eject ink on a printing medium. The firing circuits respectively transmits firing signal to each firing element, which would be introduced later. By properly defining the firing timing of each nozzle, the nozzles on the printhead would draw a vertical line on the printing medium during printing. Owing to the angle θ between the orientation of the printhead and the arrow in FIG. 3, the vertical resolution of the printhead is better than the resolution of the printhead is disposed straightforward. In the present embodiment, θ is 135 degrees. If the printhead disposed perpendicular to the arrow has the resolution of 212 dpi, the printhead with θ of 135 degrees has the resolution about 300 dpi (i.e., $212*\sqrt{2}$). In the preferable embodiment, the printhead resolution is up to 600 DPI in this invention when slanting printhead with θ of 135 degrees. For the same printhead, different vertical resolution can be achieved by changing the value of θ. In other embodiments, θ may not be limited and can be changed by desired resolution. According to the preferred embodiments, θ is in the range of 10-80 or 100-170 degrees.

Figure 4A:
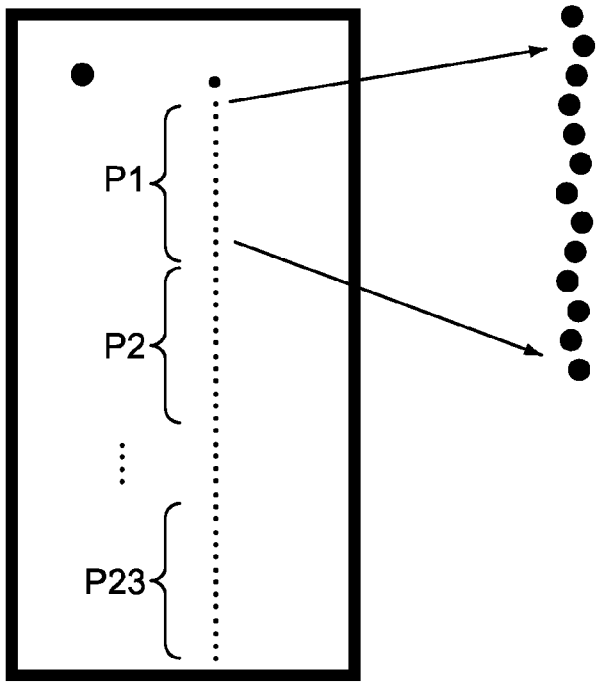
FIG. 4A illustrates the nozzle arrangement of a preferred embodiment of the present invention.
Figure 4B:
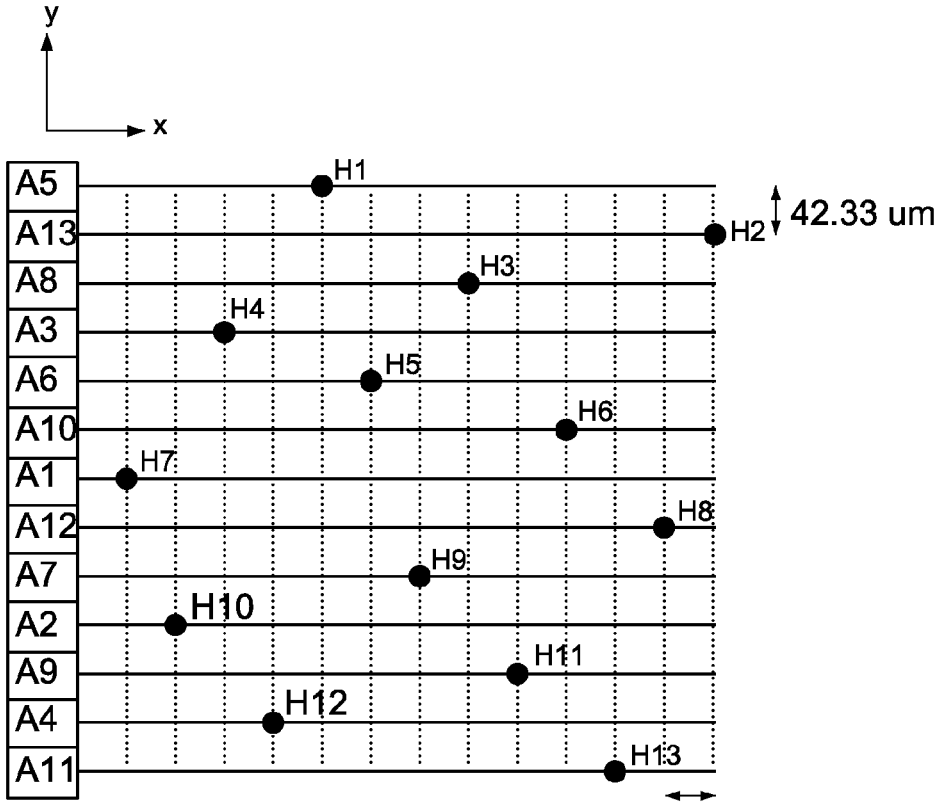
FIG. 4B illustrates the locations of the nozzles in a primitive group with enlarged scale in the direction of x-axis and the firing sequence of the nozzles.

To solve the problem of crosstalk between the firing signals, the present invention provides a unique nozzle arrangement. FIG. 4A shows the arrangement of the nozzles on the printhead. The nozzles are classified into a first number of primitive groups P1, P2, PN, and each primitive group comprises a second number of nozzles H1, H2, . . . HM. According to the present embodiment, the first number is 23 and the second number is 13. The nozzles in a primitive group form a substantial but not exactly straight line. FIG. 4B shows the locations of the nozzles H1, H2, H3 . . . H13 in a primitive group and with enlarged scale in the direction of x-axis. FIG. 4B also shows the firing sequence of each nozzle as A1, A2, A3 . . . A13. The nozzles in a primitive group is arranged by Rule 1 that the difference between timings for firing any two adjacent nozzles is at least two predetermined time intervals and/or Rule 2 that two sequentially fired nozzles are spaced apart at least two nozzle positions.

Take the arrangement depicted in FIG. 4B as an example. The nozzles in the primitive group is named as H1, H2, H3 . . . H13 and have the firing sequence A5, A13, A8 . . . A11, respectively. The solid circle denotes the location of each nozzle. Therefore, these nozzles are fired in the sequence of H7 (A1), H10 (A2), H4 (A3), H12 (A4), H1 (A5), H5 (A6), H9 (A7), H3 (A8), H11 (A9), H6 (A10), H13 (A11), H8 (A12), H2 (A13). Rule 1 stipulates that the difference between the timings for energizing any two adjacent nozzles is at least two predetermined time intervals. For example, the timing difference for energizing H1 (A5) and H2 (A13) is 8 time intervals, and the timing difference for energizing H2 (A13) and H3 (A8) is 5 time intervals. In the present embodiment, the predetermined time interval is in the range of 100 ns to 10 us. Rule 2 stipulates that any two sequentially fired nozzles are spaced apart at least two nozzle positions. For example, the distance between nozzles H7 (A1) and H10 (A2) in y-axis is three nozzle positions, the distance between nozzles H10 (A2) and H4 (A3) in y-axis is six nozzle positions, and distance between nozzles H4 (A3) and H12 (A4) in y-axis is eight nozzle positions. As depicted in FIG. 4B, all nozzles comply with Rule 1 and Rule 2. According to an embodiment of the present invention, the nozzle arrangement in each primitive group is the same and thus complies with Rule 1 and Rule 2. Nevertheless, either Rule 1 or Rule 2 can prevent the crosstalk of the firing signal and thus can be applied to the present invention individually or simultaneously. In the preferred embodiment, both Rule 1 and Rule 2 are utilized.

Presuming the location of nozzle H1 being the starting point, in the present embodiment of FIG. 4A, the location of each nozzle in primitive group 1 on the X-Y coordinates is described in the following Table 1.

TABLE 1

| Nozzle # | X (um) | Y (um) | Firing sequence | Δ |
|---|---|---|---|---|
| 1 | 0 | 0 | A4 | |
| 2 | 5.748 | −65.611 | A1 | Δ1 |
| 3 | 2.156 | −121.882 | A7 | Δ2 |
| 4 | −1.437 | −178.154 | A13 | Δ3 |
| 5 | 0.719 | −240.173 | A10 | Δ4 |
| 6 | 3.592 | −302.91 | A5 | Δ5 |
| 7 | −2.873 | −356.308 | A2 | Δ6 |
| 8 | 5.029 | −424.074 | A8 | Δ7 |

TABLE 1-continued

| Nozzle # | X (um) | Y (um) | Firing sequence | Δ |
|---|---|---|---|---|
| 9 | 1.437 | −480.346 | A11 | Δ8 |
| 10 | −2.155 | −536.67 | A3 | Δ9 |
| 11 | 2.874 | −601.51 | A6 | Δ10 |
| 12 | −0.718 | −657.782 | A12 | Δ11 |
| 13 | 4.311 | −722.674 | A9 | Δ12 |

Figure 5:
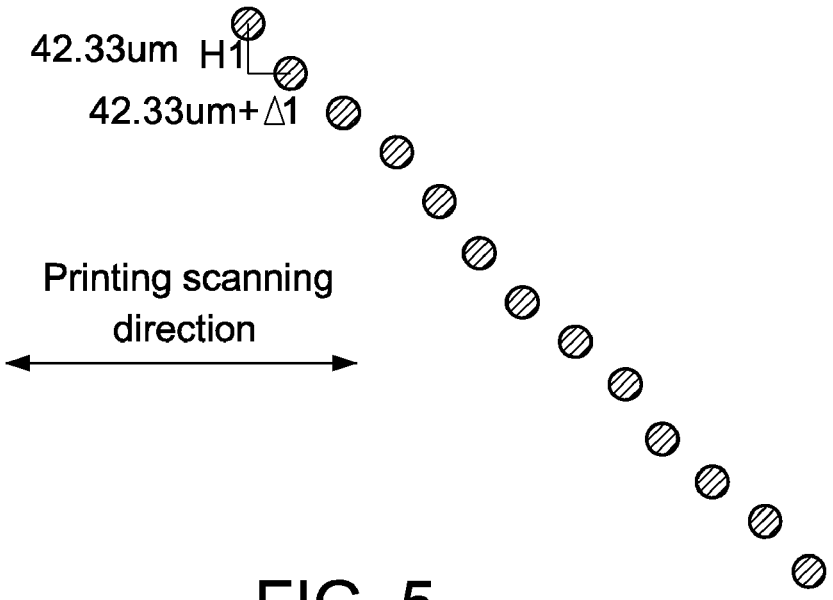
FIG. 5 illustrates the relative moving of the printhead and the printing medium.

In Table 1, Δ represents the distance between nozzle H1 and 13 projected on the x-axis where the predetermine number of Δ is corresponding to firing sequence of every nozzles in primitive group 1. Each primitive group repeats the same nozzle arrangement and the firing sequence to fire only one nozzle in each group in a time during printing. As the printhead is slanted 135 degrees to the printing scanning direction as depicted in FIG. 5, the locations of nozzles are changed as shown in Table 2. The coordinate of New X on the table 2 is derived by the coordinate of X on the table 1 and multiply by √2 plus the horizontal shift while rotate a angle, where the angle in this embodiment is 135 degrees. The coordinate of New Y is extracted from the coordinate of X on the table 1 and divide by √2.

TABLE 2

| Nozzle # | New X (um) | New Y (um) | Firing sequence |
|---|---|---|---|
| 1 | 0 | 0 | A4 |
| 2 | 8.128 + 42.33 | −42.33 | A1 |
| 3 | 3.048 + 84.66 | −84.66 | A7 |
| 4 | −2.032 + 126.99 | −126.99 | A13 |
| 5 | 1.016 + 169.32 | −169.32 | A10 |
| 6 | 5.08 + 211.65 | −211.65 | A5 |
| 7 | −4.064 + 253.98 | −253.98 | A2 |
| 8 | 7.112 + 296.31 | −296.31 | A8 |
| 9 | 2.032 + 338.64 | −338.64 | A11 |
| 10 | −3.048 + 380.97 | −380.97 | A3 |
| 11 | 4.064 + 423.3 | −423.3 | A6 |
| 12 | −1.016 + 465.63 | −465.63 | A12 |
| 13 | 6.096 + 507.96 | −507.96 | A9 |

Figure 6:
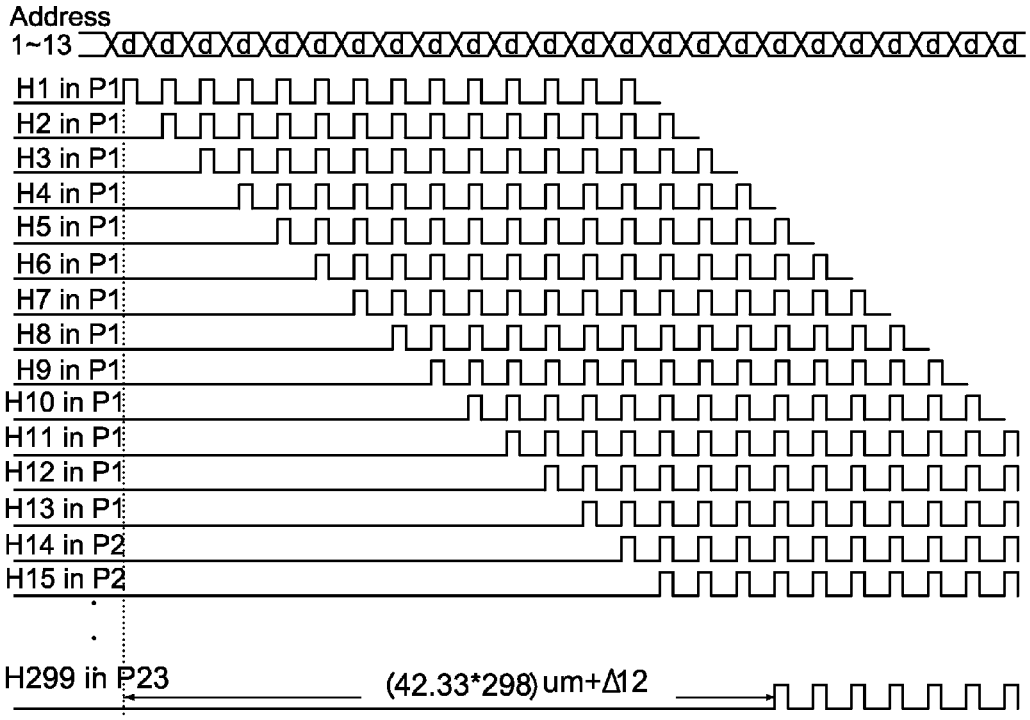
FIG. 6 is a timing diagram for energizing the nozzles in every primitive group.

To form a vertical line on the printing medium, the timing diagram for energizing the nozzles H1, H2 . . . H13 in every primitive group P1, P2 . . . P23 is depicted in FIG. 6. According to the nozzle arrangement of the present embodiment, the firing timing of the nozzle H1 has no delay, the firing timing of the nozzle H2 has the delay of (42.33 um*1+Δ1*√2) divided by the relative moving rate between the printhead and the printing medium; the firing timing of the nozzle H3 has the delay of (42.33 um*2+Δ2*√2) divided by the relative moving rate between the printhead and the printing medium; the firing timing of the nozzle H4 has the delay of (42.33 um*3+Δ3*√2) divided by the relative moving rate between the printhead and the printing medium . . . and so on.

Please note that the nozzle arrangement in the primitive group should comply with Rule 1 and/or Rule 2 mentioned above, and is not limited to the arrangement shown in FIG. 4B. As the nozzle arrangement changed, the values of Δ changes, and thus the firing timing of the nozzles changed. Furthermore, if the angle which the printhead slants or the relative moving rate changes, the firing timing changes. Persons skilled in the art can easily derive detail firing timing based on the above disclosure when the angle, which the printhead slants, the relative moving rate of printhead or nozzle arrangement changes.

Another preferred embodiment of the present invention also provides a printhead for thermal inkjet printing, comprising: a substrate having a plurality of orifices with a firing element in each of said plurality of orifices, wherein said plurality of orifices are arranged in at least two columns, and said printhead is disposed at an angle to a horizontal direction along which said printhead scans; and a firing circuit for energizing said plurality of firing elements to eject ink on a printing medium by respectively transmitting a plurality of firing signals to said plurality of firing elements, wherein said plurality of firing elements in one column are energized independent to said plurality of firing elements in another column. Since the printhead in the present embodiment has more than one column of firing elements independently energized, the print speed can be increased.

Figure 7:
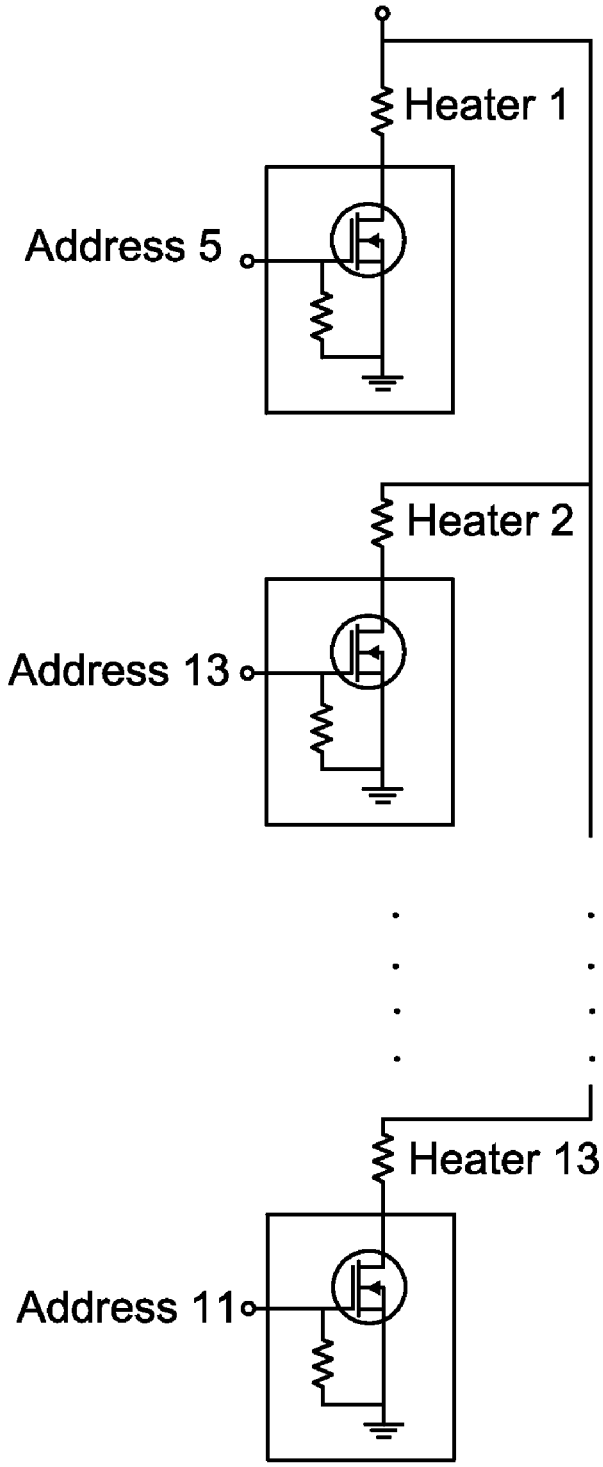
FIG. 7 is the schematic diagram of the firing circuit for nozzles of a primitive group in the printhead of the preferred embodiment of the present invention.

FIG. 7 shows the schematic diagram of the firing circuit for firing elements of a primitive group in the printhead of the preferred embodiment. The gate of each MOSFET is electrically connected to the address of firing elements. When the address is triggered, the firing element is energized by the firing signal and then ejects ink.

In view of the above, the printhead provided by the present invention has at least the advantages of (1) reducing cross talk; (2) increasing number of nozzles in the same printhead area; and (3) improving print speed. The nozzle arrangement pursuant is to Rule 1 that the difference between timings for energizing any two adjacent nozzles is at least two predetermined time intervals and/or Rule 2 that two sequentially fired nozzles are spaced apart at least two nozzle positions can reduce the crosstalk between firing signals significantly. Compared with the traditional nozzle arrangement, since the printhead is slanted and nozzles are arranged in a single column, the present invention contains more nozzles in the same printhead area and thus the resolution thereof is better than the printhead disposed straight forward. Furthermore, with the same printhead area, the printhead of the present invention is prolonged, which results in higher print speed through the longer print swath.

It will be apparent to those skilled in the art that various modifications and variations can be made to the structure of the present invention without departing from the scope or spirit of the invention. In view of the foregoing, it is intended that the present invention covers modifications and variations of this invention, provided that they fall within the scope of the following claims and their equivalents.

What is claimed is:

1. A printhead for thermal inkjet printing, comprising:

a substrate having a plurality of orifices with a firing element in each of said plurality of orifices, wherein said plurality of orifices are arranged in a single column, said plurality of firing elements are classified into a first number of groups, and each group comprises:

a second number of firing elements, wherein said second number of firing elements in a group are arranged such that each of said second number of firing elements is energized at a different time, and the time difference for energizing any two adjacent firing elements is at least two predetermined time intervals, and are located such that two sequentially fired firing elements are separated by at least two other firing elements, and a firing circuit for energizing said plurality of firing elements to eject ink on a printing medium by respectively transmitting a plurality of firing signals to said plurality of firing elements;

wherein said printhead is disposed at an angle to a horizontal direction along which said printhead scans, and said angle is substantially not equal to 90 degrees.

2. The printhead as claimed in claim 1, wherein the timing for energizing one of said plurality of firing elements is determined based on the location of said firing element on said printhead, the relative moving rate between said printing medium and said printhead, and said angle between said printhead and a direction along which said printhead scans.

3. The printhead as claimed in claim 1, wherein said second number of firing elements in each group are arranged in the same manner.

4. The printhead as claimed in claim 1, wherein said angle is in the range of 10-80 or 100-170 degrees.

5. The printhead as claimed in claim 1, wherein said angle is at 135 degrees.

6. The printhead as claimed in claim 1, wherein said predetermined time interval is in the range of 100 ns to 10 us.

7. A printhead for thermal inkjet printing, comprising:

a substrate having a plurality of orifices with a firing element in each of said plurality of orifices, wherein said plurality of orifices are arranged in at least two columns, wherein said plurality of firing elements are classified into a first number of groups, and each group comprises a second number of firing elements, wherein said second number of firing elements in a group are arranged such that each of said second number of firing elements is energized at a different time, and the time difference for energizing any two adjacent firing elements is at least two predetermined time intervals, and are located such that two sequentially fired firing elements are separated by at least two other firing elements, and a firing circuit for energizing said plurality of firing elements to eject ink on a printing medium by respectively transmitting a plurality of firing signals to said plurality of firing elements;

wherein firing elements energized in one column are independent of firing elements energized in another column, and said printhead is disposed at an angle to a horizontal direction along which said printhead scans; and said angle is substantially not equal to 90 degrees.

8. The printhead as claimed in claim 7, wherein the timing for energizing one of said plurality of firing elements is determined based on the location of said firing element on said printhead, the relative moving rate between said printing medium and said printhead, and said angle between said printhead and a direction along which said printhead scans.

9. The printhead as claimed in claim 7, wherein said second number of firing elements in each group are arranged in the same manner.

10. The printhead as claimed in claim 7, wherein said angle is in the range of 10-80 or 100-170 degrees.

11. The printhead as claimed in claim 7, wherein said angle is about 135 degrees.

12. The printhead as claimed in claim 7, wherein the said predetermined time interval is in the range of 100 ns to 10 us.

13. A printing method for a printhead having a plurality of firing elements classified into a plurality of groups, comprising:

energizing each of said plurality of firing elements by a plurality of firing signals, respectively, wherein each of said firing elements is energized at a different time, and the time difference for energizing any two adjacent firing elements is at least two predetermined time intervals; and wherein said plurality of firing elements are located such that two sequentially fired firing elements are separated by at least two other firing elements.

14. The method as claimed in claim 13, wherein the timing for energizing one of said plurality of firing elements is determined based on the location of said firing element on said printhead, the relative moving rate between a printing medium and said printhead, and an angle between said printhead and a direction along which said printhead scans.

15. The method as claimed in claim 13, wherein the said predetermined time interval is in the range of 100 ns to 10 us.

* * * * *